US005491376A

United States Patent [19]

Levine et al.

[11] Patent Number: 5,491,376

[45] Date of Patent: Feb. 13, 1996

[54] FLAT PANEL DISPLAY ANODE PLATE HAVING ISOLATION GROOVES

[75] Inventors: Jules D. Levine, Dallas; Chi-Cheong Shen, Richardson; Bruce E. Gnade, Dallas, all of Tex.

[73] Assignee: Texas Instruments Incorporated, Dallas, Tex.

[21] Appl. No.: 253,476

[22] Filed: Jun. 3, 1994

[51] Int. Cl.[6] ..... H01J 17/24; H01J 1/62; H01J 29/10

[52] U.S. Cl. ..... 313/495; 313/553; 313/496; 313/461

[58] Field of Search ..... 313/553, 554–562, 313/481, 495, 496, 497, 461, 466, 467, 351, 309, 336

[56] References Cited

U.S. PATENT DOCUMENTS

| | | | |
|---|---|---|---|
| 3,755,704 | 8/1973 | Spindt et al. | 313/309 |
| 3,863,087 | 1/1975 | Holz | 313/220 |
| 4,720,655 | 1/1988 | Hinotani | 313/466 |
| 4,940,916 | 7/1990 | Borel et al. | 313/306 |
| 5,015,912 | 5/1991 | Spindt | 313/495 |
| 5,194,780 | 3/1993 | Meyer | 315/169.3 |
| 5,225,820 | 7/1993 | Clerc | 340/752 |

*Primary Examiner*—Sandra L. O'Shea
*Assistant Examiner*—John Ning
*Attorney, Agent, or Firm*—Christopher L. Maginniss; W. James Brady, III; Richard L. Donaldson

[57] ABSTRACT

A grooved anode plate 40 for use in a field emission flat panel display device comprises a transparent planar substrate 42 having a plurality of electrically conductive, parallel stripes 46 comprising the anode electrode of the device, which are covered by phosphors $\mathbf{48}_R$, $\mathbf{48}_G$ and $\mathbf{48}_B$. In one embodiment, grooves 50, having generally straight sidewalls, are formed in the upper surface of planar substrate 42 at the interstices of conductors 46. In a second embodiment, grooves 50', which provide a substantial undercutting of the material of substrate 42' adjacent the edges of conductors 46', are formed in the upper surface of planar substrate 42' at the interstices of conductors 46'. A substantially opaque, electrically insulating material 52 is affixed to substrate 42 in the grooves 50 formed between conductors 46, acting as a barrier to the passage of ambient light into and out of the device. The grooves 50 in the surface of substrate 42 and the electrical insulating quality of opaque material 52 increase the electrical isolation of conductive stripes 46 from one another, reducing the risk of breakdown due to increased leakage current. Opaque material 52 preferably comprises glass having impurities dispersed therein, wherein the impurities may include one or more organic dyes, selected to provide relatively uniform opacity over the visible range of the electromagnetic spectrum. Alternatively, the impurities may include the black oxide of a transition metal such as cobalt. Two methods of fabricating grooved anode plate 40 are disclosed.

33 Claims, 4 Drawing Sheets

FLAT PANEL DISPLAY ANODE PLATE HAVING ISOLATION GROOVES

RELATED APPLICATION

U.S. patent application Ser. No. 08/491,747, "Opaque Insulator for Use on Anode Plate of Flat Panel Display," filed 24 May 1994 .

TECHNICAL FIELD OF THE INVENTION

The present invention relates generally to flat panel displays and, more particularly, to an anode plate for use in a flat panel display having grooves formed in the substrate in the spaces between the anode conductors, and to a method of fabricating such anode plate.

BACKGROUND OF THE INVENTION

The advent of portable computers has created intense demand for display devices which are lightweight, compact and power efficient. Since the space available for the display function of these devices precludes the use of a conventional cathode ray tube (CRT), there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color liquid crystal display screens tend to be far more costly than CRT's of equal screen size.

As a result of the drawbacks of liquid crystal display technology, field emission display technology has been receiving increasing attention by industry. Flat panel displays utilizing such technology employ a matrix-addressable array of pointed, thin-film, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Frédéric Clerc. These patents are incorporated by reference into the present application.

The Clerc ('820) patent discloses a trichromatic field emission flat panel display having a first substrate on which are arranged a matrix of conductors. In one direction of the matrix, conductive columns comprising the cathode electrode support the microtips. In the other direction, above the column conductors, are perforated conductive rows comprising the grid electrode. The row and column conductors are separated by an insulating layer having apertures permitting the passage of the microtips, each intersection of a row and column corresponding to a pixel.

On a second substrate facing the first, the display has regularly spaced, parallel conductive stripes comprising the anode electrode. These stripes are alternately covered by a first material luminescing in the red, a second material luminescing in the green, and a third material luminescing in the blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated or "switched on" in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

Two shortcomings of field emission displays of the current technology are the low contrast ratio of the display and the low emission intensity of the low voltage phosphors typically used as the luminescent materials on the display screen. The low contrast ratio is due in part to ambient light which enters through the front of the display, reflects off the planar surface of the emitter plate, and re-emerges between the phosphor stripes on the switched anode color display.

The low emission intensity of the phosphor has several origins, one of which is the low acceleration voltage used to excite the free electrons toward the anode. Currently, this acceleration voltage is limited by the potential which can be placed on the transparent stripe anode conductors underlaying the phosphor stripes, typically at about 300 volts. It is known that significantly improved performance would be provided by increasing the anode potential to about 1000 volts. However, as the acceleration voltage is increased, the leakage current between the conductive anode stripes also increases, eventually leading to breakdown when the leakage current becomes excessive. The sources of this leakage current between adjacent anode stripes include residual interstitial traces of anode conductor material which are not completely removed during the fabrication of the stripes, field emission from the stripe edges which are sharpened during fabrication, and the smooth glass surface of the substrate itself.

In view of the above, it is clear that there exists a need for an improvement in the anode plate of a field emission flat panel display device which permits increased acceleration voltage to thereby provide higher efficiency of the phosphor material being used.

SUMMARY OF THE INVENTION

In accordance with the principles of the present invention, there is disclosed herein an anode plate for use in a field emission device. The anode plate comprises a substantially transparent substrate having spaced-apart, electrically conductive regions on a surface thereof, and luminescent material overlying the conductors. The substrate has grooves formed on the surface in the spaces between the conductive regions.

In a preferred embodiment of the present invention, the depth of the grooves below the surface is between 0.3 and 10 μmeters. Also in a preferred embodiment, a substantially opaque, electrically insulating material is deposited in the grooves.

Further in accordance with the principles of the present invention, there is disclosed herein a method of fabricating an anode plate for use in a field emission device. The method comprises the steps of providing a substantially transparent substrate having spaced-apart, electrically conductive regions on a surface thereof, etching grooves in the surface in the spaces between said electrically conductive regions, and applying luminescent material on the conductive regions.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
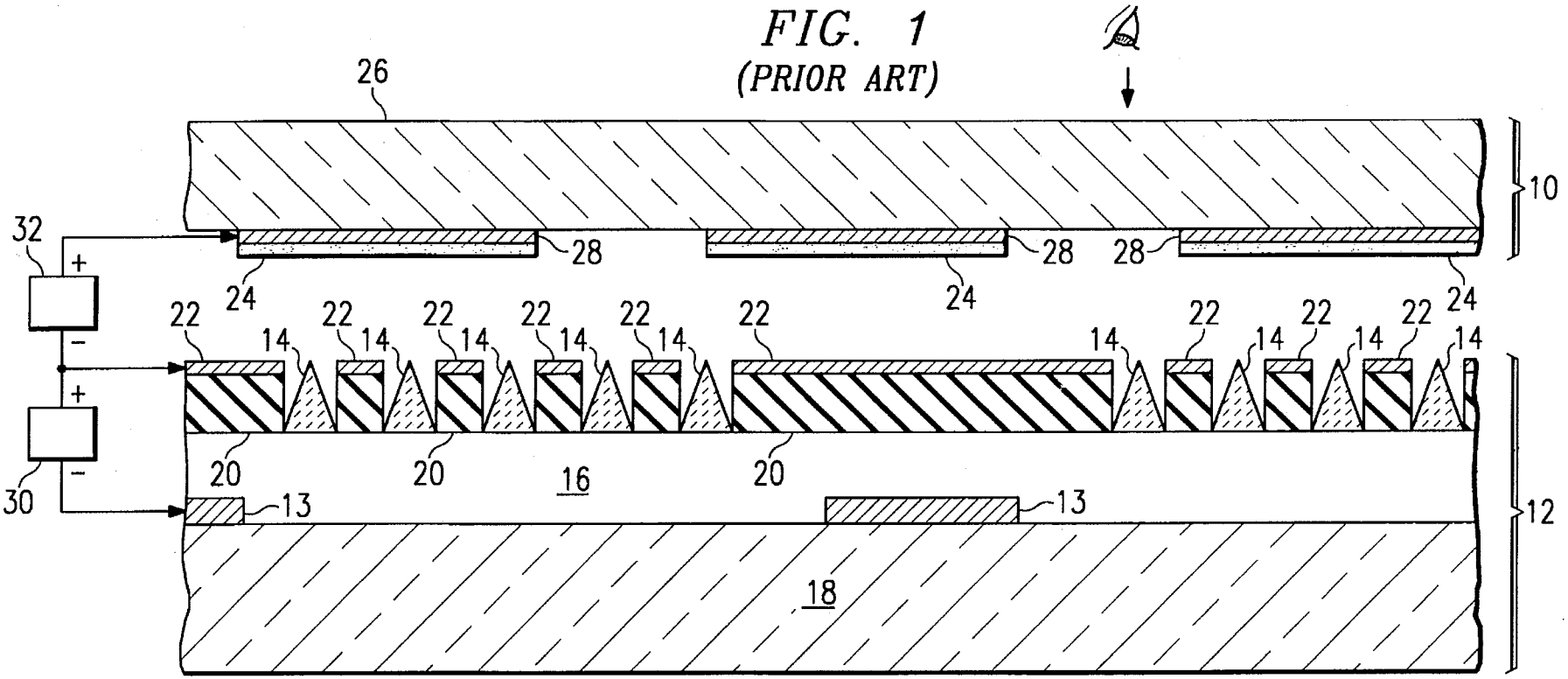
FIG. 1 (PRIOR ART)
FIG. 1 illustrates in cross section a portion of a field emission flat panel display device according to the prior art.

Referring initially to FIG. 1, there is shown, in cross-sectional view, a portion of an illustrative, prior an field emission flat panel display device. In this embodiment, the field emission device comprises an anode plate having an electroluminescent phosphor coating facing an emitter plate, the phosphor coating being observed from the side opposite to its excitation.

More specifically, the illustrative field emission device of FIG. 1 comprises a cathodoluminescent anode plate 10 and an electron emitter (or cathode) plate 12. (No true scaling information is intended to be conveyed by the relative sizes and positioning of the elements of anode plate 10 and the elements of emitter plate 12 as depicted in FIG. 1.) The cathode portion of emitter plate 12 includes conductors 13 formed on an insulating substrate 18, a resistive layer 16 also formed on substrate 18 and overlying conductors 13, and a multiplicity of electrically conductive microtips 14 formed on resistive layer 16. In this example, conductors 13 comprise a mesh structure, and microtip emitters 14 are configured as a matrix within the mesh spacings.

A gate electrode comprises a layer of an electrically conductive material 22 which is deposited on an insulating layer 20 which overlies resistive layer 16. Microtip emitters 14 are in the shape of cones which are formed within apertures through conductive layer 22 and insulating layer 20. The thicknesses of gate electrode layer 22 and insulating layer 20 are chosen in conjunction with the size of the apertures therethrough so that the apex of each microtip 14 is substantially level with the electrically conductive gate electrode layer 22. Conductive layer 22 is arranged as rows of conductive bands across the surface of substrate 18, and the mesh structure of conductors 13 is arranged as columns of conductive bands across the surface of substrate 18, thereby permitting selection of microtips 14 at the intersection of a row and column corresponding to a pixel.

Anode plate 10 comprises regions of a transparent, electrically conductive material 28 deposited on a transparent planar support 26, which is positioned facing gate electrode 22 and parallel thereto, the conductive material 28 being deposited on the surface of support 26 directly facing gate electrode 22. In this example, the regions of conductive material 28, which comprise the anode electrode, are in the form of electrically isolated stripes comprising three series of parallel conductive bands across the surface of support 26, as taught in the Clerc ('820) patent. Anode plate 10 also comprises a cathodoluminescent phosphor coating 24, deposited over conductive regions 28 so as to be directly facing and immediately adjacent gate electrode 22.

One or more microtip emitters 14 of the above-described structure are energized by applying a negative potential to conductors 13, functioning as the cathode electrode, relative to the gate electrode 22, via voltage supply 30, thereby inducing an electric field which draws electrons from the apexes of microtips 14. The freed electrons are accelerated toward the anode plate 10 which is positively biased by the application of a substantially larger positive voltage from voltage supply 32 coupled between the gate electrode 22 and conductive regions 28 functioning as the anode electrode. Energy from the electrons attracted to the anode conductors 28 is transferred to the phosphor coating 24, resulting in luminescence. The electron charge is transferred from phosphor coating 24 to conductive regions 28, completing the electrical circuit to voltage supply 32.

Figure 2:
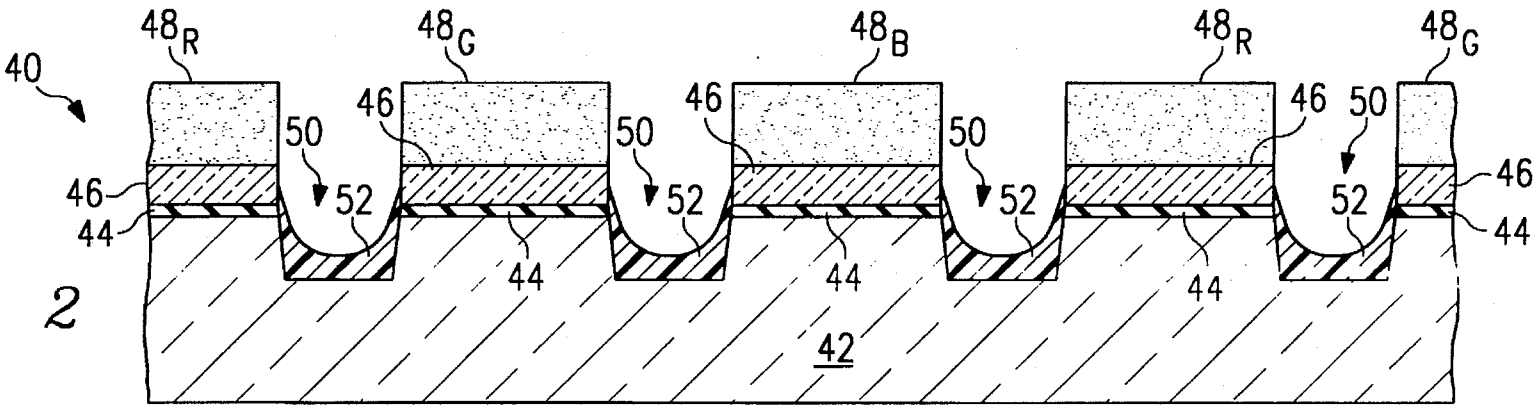
FIG. 2 is a cross-sectional view of an anode plate having isolation grooves in accordance with the present invention.

Referring now to FIG. 2, there is shown a cross-sectional view of an anode plate 40 for use in a field emission flat panel display device in accordance with the present invention. Anode plate 40 comprises a transparent planar substrate 42 having a layer 44 of an insulating material, illustratively silicon dioxide ($SiO_2$). A plurality of electrically conductive regions 46 are patterned on insulating layer 44. Conductive regions 46 collectively comprise the anode electrode of the field emission flat panel display device of the present invention. Luminescent material $\mathbf{48}_R$, $\mathbf{48}_G$ and $\mathbf{48}_B$, referred to collectively as luminescent material 48, overlies conductors 46. Grooves 50, having substantially straight sidewalls, are formed in the upper surface of planar substrate 42 at the spaces between conductors 46. Finally, a substantially opaque, electrically insulating material 52 is formed within grooves 50.

Grooves 50, which are formed in the upper surface of substrate 42 after the formation of conductors 46, enhance the electrical isolation between adjacent conductors 46 by removing residual traces of conductive material within the spaces between conductors 46, and by removing the sharp edges of conductors 46, thereby avoiding field emission from their edges. In addition, the process by which grooves 50 are formed roughens the surface of substrate 42, which minimizes surface leakage compared to a smooth surface.

Opaque material 52 fills in the gaps between conductive regions 46, thereby acting as a barrier to the entry of ambient light into the device, and further preventing the re-emergence of light reflected from the active surface of emitter plate 12 (of FIG. 1). For purposes of this disclosure, the term "opaque" shall refer to a very low degree of optical transmissivity in the visible range, i.e. , in the region of the electromagnetic spectrum between approximately 400–800 nanometers.

In the present example, substrate 42 comprises glass; $SiO_2$ insulating layer 44, which is typically provided by the manufacturer of substrate 42, adds smoothness to the surface of substrate 42 and acts as a diffusion barrier. Also in this example, conductive regions 46 comprise a plurality of parallel stripe conductors which extend normal to the plane of the drawing sheet. A suitable material for use as stripe conductors 46 may be indium-tin-oxide (ITO), which is optically transparent and electrically conductive. In this example, luminescent material 48 comprises a particulate or thin-film phosphor coating which luminesces in one of the three primary colors, red ($\mathbf{48}_R$), green ($\mathbf{48}_G$) and blue ($\mathbf{48}_B$). A preferred process for applying phosphor coatings 48 to stripe conductors 46 comprises electrophoretic deposition.

By way of illustration, stripe conductors 46 may be 80 microns in width, and spaced from one another by 30 microns. The thickness of conductors 46 may be approximately 150 nanometers, and the thickness of phosphor coatings 48 may be approximately 15 microns. According to the present invention, grooves 50 may be from 0.3 to 10 microns below the surface of substrate 42, typically between 3 and 10 microns.

The substantially opaque, electrically insulating material 52 preferably comprises glass having impurities dispersed therein, wherein the impurities may include one or more organic dyes, the combination of dyes being selected to provide relatively uniform opacity over the visible range of the electromagnetic spectrum. Alternatively, the impurities may include an oxide of a transition metal, the transition metal being chosen from among those which form black oxides. In the latter case, the metallic oxide particles must be sufficiently dispersed with the glass that material 52 retains a high degree of electrical insulating quality. By way of illustration, the average thickness of material 52 may be on the order of 0.5 to 1.0 microns.

Opaque, electrically insulating material 52 is preferably formed from a solution of tetraethylorthosilicate (TEOS), which is sold by, for example, AlliedSignal, Inc., of Morristown, N.J. The solution of TEOS, including a solvent which may comprise ethyl alcohol, acetone, N-butyl alcohol and water, is commonly referred to as "spin-on-glass" (SOG). The TEOS and solvents are combined in proportions according the desired viscosity of the spin-on-glass solution. TEOS provides the advantages that it cures at a relatively low temperature and, when fully cured, all of the solvent and most of the organic materials have been driven out, leaving primarily glass ($SiO_x$). The TEOS solution may be spun on the surface of anode plate 40, or it may be spread on the surface, using techniques which are well known in the manufacture of, tier example, liquid crystal display devices.

The impurities which produce the opacity of material 52 fall into two general categories, organic dyes and metallic oxides. Organic dyes are advantageous in that they disperse readily and uniformly throughout the TEOS solution, without diminishing its insulating quality, but they are limited in the temperature range to which they can be exposed, typically to less than 200° C. In an example illustrating a formulation of material 52 including an organic dye, either a single dye, such as Sudan Black, or a mixture of dyes, is added at a typical concentration of 13 mg of dye/ml of the solution of TEOS and solvents.

The second category of impurities which produce the opacity of material 52 comprises metallic oxides. Compounds of transition metals which are soluble in the TEOS solution provide sources of metallic ions which may form dark, preferably black, oxides during the TEOS curing process. Such compounds may include, but are not limited to, nitrates, sulfates, hydroxides, acetates and other metal organic compounds of the transition metals. Transition metals which form black oxides include, but are not limited to, cobalt and copper. In most cases, the transition metal ion is converted to the metal oxide during the curing cycle.

The following example illustrates a formulation of material 52 including a compound of a transition metal. Cobalt nitrate ($Co(NO_3)_2$) is added to a solution of TEOS and solvent, comprising alcohol and acetone, in the amount of 375 mg/ml. This combination also includes 0.5 ml of 1-butanol per ml of the TEOS solution to improve the uniformity of the mixture. As is the case for organic dyes, a plurality of different metal ion solutions, each of which is opaque over a portion of the visible spectrum, can be combined to minimize the optical transmission over the entire range from 400–800 nanometers.

Figure 3:
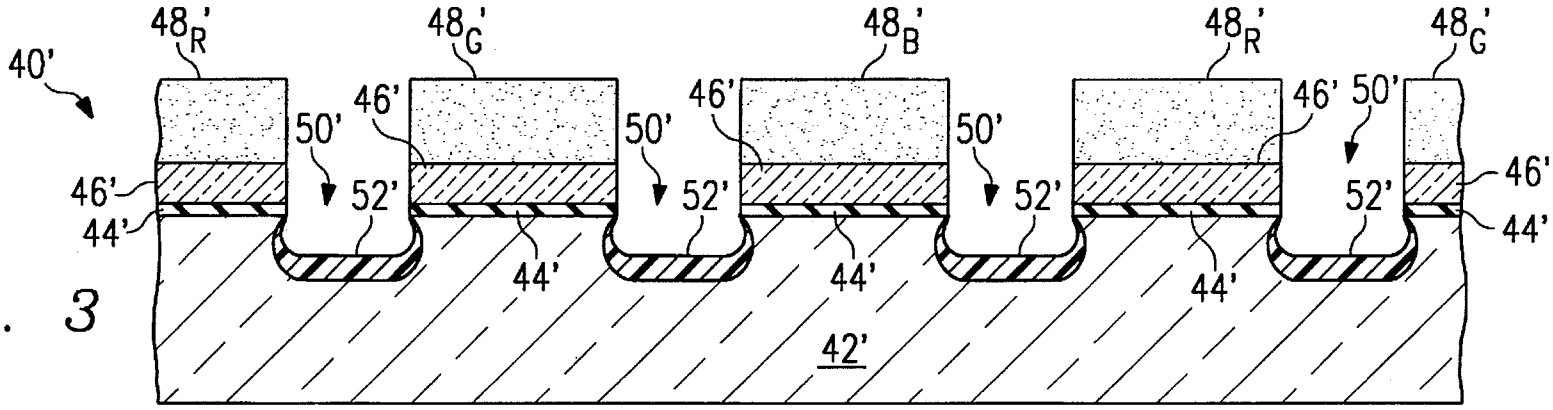
FIG. 3 is a cross-sectional view of an anode plate having undercut isolation grooves in accordance with the present invention.

Referring now to FIG. 3, there is shown in cross-sectional view an anode plate 40' having undercut isolation grooves 50' in accordance with the present invention. In the following paragraph relating to FIG. 3, elements which are similar in structure and which perform identical functions to those already described in relation to FIG. 2 are given the primed numerical designators of their counterparts.

Anode plate 40' comprises a transparent planar substrate 42' having a layer 44' of an insulating material, illustratively silicon dioxide ($SiO_2$). A plurality of electrically conductive regions 46' are patterned on insulating layer 44'. Luminescent material $\mathbf{48}_R'$, $\mathbf{48}_G'$ and $\mathbf{48}_B'$ overlies conductors 46. Grooves 50', which provide a substantial undercutting of the material of substrate 42' adjacent the edges of conductors 46', are formed in the upper surface of planar substrate 42' at the interstices of conductors 46'. Finally, a substantially opaque, electrically insulating material 52' is formed within grooves 50'.

Figure 4A:
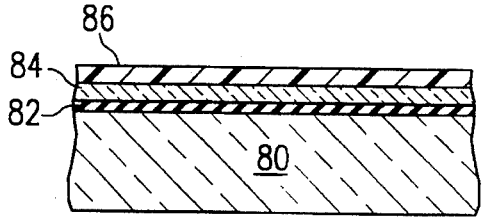
FIGS. 4A through 4I illustrate steps in a process for fabricating the anode plate of FIG. 2 in accordance with a first embodiment of the present invention.

A method of fabricating an anode plate for use in a field emission flat panel display device in accordance with a first embodiment incorporating the principles of the present invention, comprises the following steps, considered in relation to FIGS. 4A through 4I. Referring initially to FIG. 4A, a glass substrate 80 is coated with an insulating layer 82, typically $SiO_2$, which may be sputter deposited to a thickness of approximately 50 nm. A layer 84 of a transparent, electrically conductive material, typically indium-tin-oxide (ITO), is deposited on layer 82, illustratively by sputtering to a thickness of approximately 150 nm. A layer 86 of photoresist, illustratively type AZ-1350J sold by Hoescht-Celanese, of Somerville, N.J., is coated over layer 84, to a thickness of approximately 1000 nm.

Figure 4B:
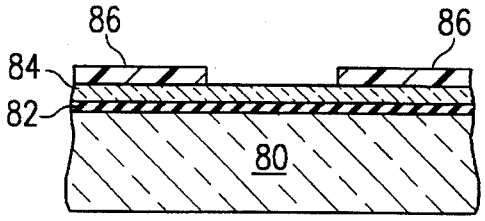
Figure 4C:
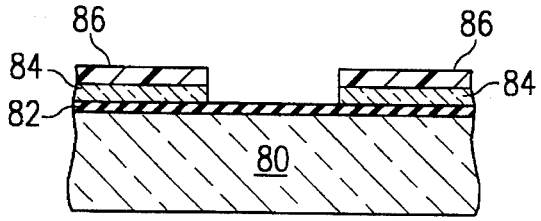

A patterned mask (not shown) is disposed over layer 86 exposing regions of the photoresist. In the case of this illustrative positive photoresist, the exposed regions are removed during the developing step, which may comprise soaking the assembly in Hoescht-Celanese AZ-developer. The developer removes the unwanted photoresist, leaving photoresist layer 86 patterned as shown in FIG. 4B. The exposed regions of ITO layer 84 are then removed, typically by a wet etch process, using as an illustrative etchant a solution of 6M hydrochloric acid (HCl) and 0.3M ferric chloride ($FeCl_3$), leaving a structure as shown in FIG. 4C. Although not shown as part of this process, it may also be desired to remove $SiO_2$ layer 82 underlying the etched-away regions of the ITO layer 84. In the present example, these patterning, developing and etching processes leave regions of ITO layer 84 which form substantially parallel stripes across the surface of the anode plate.

Figure 4D:
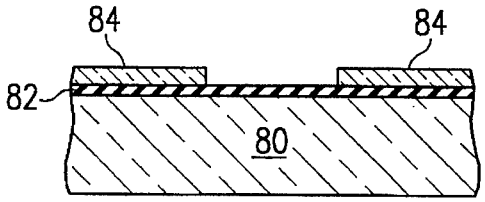

The remaining photoresist layer 86 may be removed by a wet etch process using acetone as the etchant; alternatively, layer 86 may be removed using a dry, oxygen plasma ash off process. FIG. 4D illustrates the anode structure having patterned ITO regions 84 at the current stage of the fabrication process.

Figure 4E:
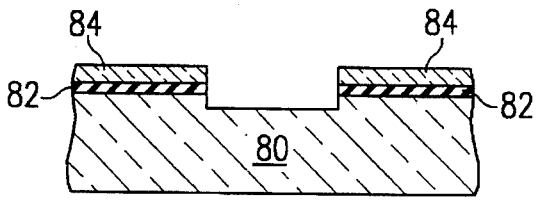

The next step in the process is to etch the grooves in the anode plate. Depending on the shape of the groove which is desired, this can be accomplished by two different means. If substantially straight sidewalls are desired, as shown in the embodiment of FIG. 2, the glass substrate can be etched using a dry etch. This would include plasma etching and reactive ion etching. A dry etch may be accomplished using an etchant gas such as carbon tetrafluoride ($CF_4$). If undercut is desired, as shown in the embodiment of FIG. 3, a wet etch, such as hydrofluoric acid (HF) buffered with ammonium fluoride ($NH_4F$), may be used. FIG. 4E illustrates the anode structure having patterned ITO regions 84 at the current stage of the fabrication process.

Figure 4F:
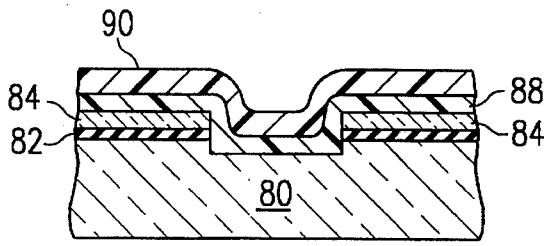

A coating 88 of spin-on-glass (SOG) including impurities which provide opacity, which may be of a type described earlier, is applied over the striped regions of layer 84 and the exposed portion of layer 82, typically to an average thickness of approximately 1000 nm above the surface of insulating layer 82. The method of application may comprise dispensing the SOG mixture onto the assembly while substrate 80 is being spun, thereby dispersing SOG coating 88 relatively uniformly over the surface and tending to accelerate the drying of the SOG solvent. Alternatively, the SOG mixture may be uniformly spread over the surface. The SOG is then precured at 100° C. for about fifteen minutes, and then fully cured by heating it until virtually all of the solvent and organics have been driven off, typically at a temperature of 300° C. for approximately four hours. A second coating 90 of photoresist, which may be of the same type used as layer 86, is deposited over the cured SOG, typically to a thickness of 1000 nm, as illustrated in FIG. 4F.

Figure 4G:
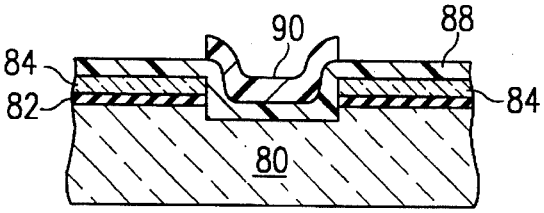
Figure 4H:
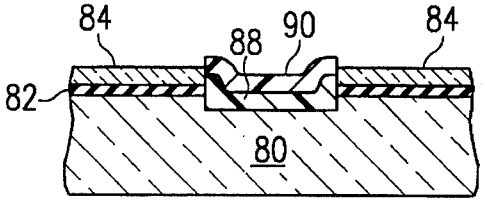

A second patterned mask (not shown) is disposed over layer 90 exposing regions of the photoresist which, in the case of this illustrative positive photoresist, are to be removed during the developing step, specifically these regions lying directly over the spaces between the stripes of layer 84. The photoresist is developed using AZ-developer, leaving photoresist layer 90 patterned as shown in FIG. 4G. The exposed regions of SOG layer 88 are then removed, typically by a wet etch process, using buffered hydrofluoric acid as an illustrative etchant, leaving a structure as shown in FIG. 4H. Alternatively, the exposed regions of SOG layer 88 may be removed using an oxide (plasma) etch process.

Figure 4I:
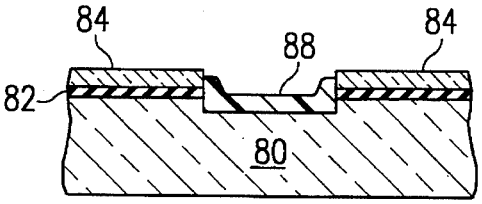

The remaining photoresist layer 90 may be removed by a wet etch process using acetone as the etchant; alternatively, layer 90 may be removed using a dry, oxygen plasma etch process. FIG. 4I illustrates the grooved anode structure having a glass insulating region 88 in the groove formed between the patterned ITO stripes 84 at this stage of the fabrication process. The final steps in the fabrication process of the anode structure is to provide the cathodoluminescent phosphor coatings 48 (of FIG. 2), which are deposited over conductive ITO regions 84, typically by electrophoretic deposition.

Figure 5A:
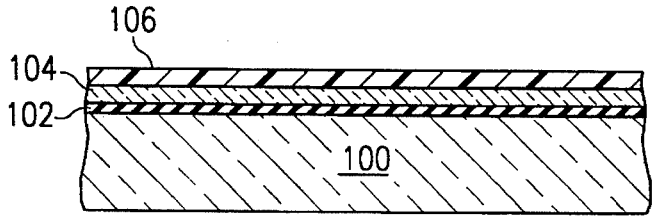
FIGS. 5A through 5F illustrate steps in a process for fabricating the anode plate of FIG. 2 in accordance with a second embodiment of the present invention.

A method of fabricating an anode plate for use in a field emission flat panel display device in accordance with a second embodiment incorporating the principles of the present invention, comprises the following steps, considered in relation to FIGS. 5A through 5F. Referring initially to FIG. 5A, a glass substrate 100 is coated with an insulating layer 102, typically $SiO_2$, which may be sputter deposited to a thickness of approximately 50 nm. A layer 104 of a transparent, electrically conductive material, typically indium-tin-oxide (ITO), is deposited on layer 102, illustratively by sputtering to a thickness of approximately 150 nm. A layer 106 of photoresist, which may be type SC-100 negative photoresist sold by OGC Microelectronic Materials, Inc., of West Patterson, N.J., is coated over layer 104, to a thickness of approximately 1000 nm.

Figure 5B:
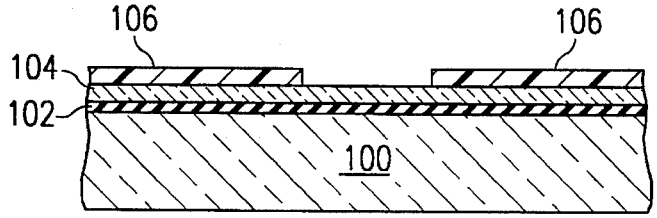
Figure 5C:
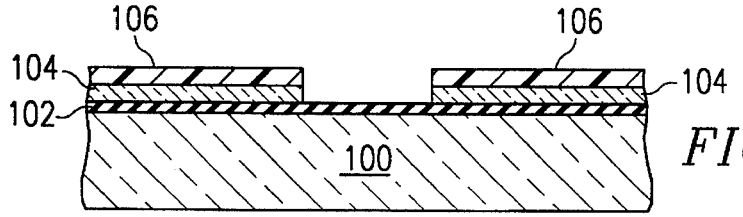
Figure 5D:
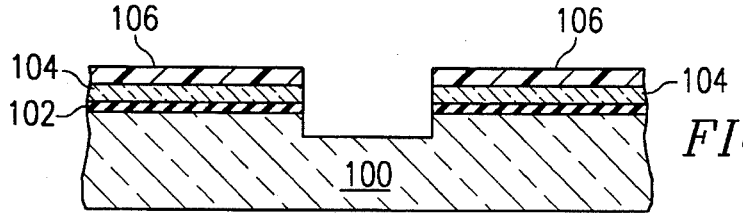

A patterned mask (not shown) is disposed over layer 106 exposing regions of the photoresist which, in the case of this illustrative negative photoresist, are to remain after the developing step, which may comprise spraying the assembly first with Stoddard etch and then with butyl acetate. The unexposed regions of the photoresist are removed during the developing step, leaving photoresist layer 106 patterned as shown in FIG. 5B. The exposed regions of ITO layer 104 are then removed, typically by a wet etch process, using as an illustrative etchant a solution of 6M hydrochloric acid (HCI) and 0.3M ferric chloride ($FeCl_3$), leaving a structure as shown in FIG. 5C. In the present example, these patterning, developing and etching processes leave regions of ITO layer 104 which form substantially parallel stripes across the surface of the anode plate.

The next step in the process is to etch the grooves in the anode plate. Depending on the shape of the groove which is desired, this can be accomplished by two different means. If substantially straight sidewalls are desired, the glass substrate can be etched using a dry etch. This would include plasma etching and reactive ion etching. Etching can be accomplished using an etchant gas such as carbon tetrafluoride ($CF_4$). If undercut is desired, a wet etch, such as buffered hydrofluoric acid (HF buffered with $NH_4F$), may be used.

Figure 5E:
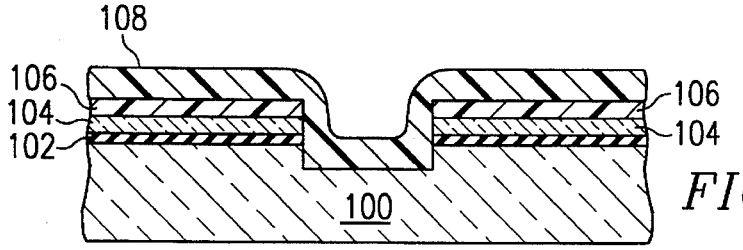

In this second embodiment, the remaining photoresist layer 106 is retained, and a coating 108 of spin-on-glass (SOG) including impurities which provide opacity, which may be of a type described earlier, is applied over the photoresist layer 106 and the exposed portion of layer 102, typically to an average thickness of approximately 1000 nm above the surface of insulating layer 102. The method of application may comprise dispensing the SOG mixture onto the assembly while substrate 100 is being spun, thereby dispersing SOG coating 108 relatively uniformly over the surface and tending to accelerate the drying of the SOG solvent. Alternatively, the SOG mixture may be uniformly spread over the surface. FIG. 5E illustrates the anode structure having patterned ITO regions 104 and photoresist regions 106, and the coating of SOG 108 at the current stage of the fabrication process. The assembly is then heated to 100° C. for about fifteen minutes to remove most of the solvent.

Figure 5F:
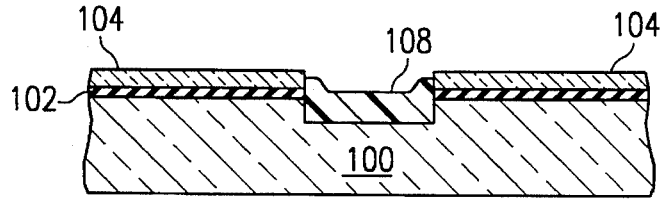

Photoresist layer 106 is then removed, bringing with it the overlying portions of SOG layer 108, resulting in the structure of FIG. 5F, which illustrates the grooved anode structure having a glass insulating region 108 in the groove formed between the patterned ITO stripes 104 at this stage of the fabrication process. This liftoff step is a common semiconductor fabrication process. Hot xylene and a solvent comprising perchloroethylene, tetrachloroethylene, orthodichlorobenzene, phenol and alkylaryl sulfonic acid, may be sprayed on the assembly in sequence, to remove the negative photoresist layer 106 of the present example. The SOG is then fully cured by heating it until virtually all of the solvent and organics have been driven off, typically at a temperature of 300° C. for approximately four hours.

The final steps in the fabrication process of the anode structure is to provide the cathodoluminescent phosphor coatings 48 (of FIG. 2), which are deposited over conductive ITO regions 104, typically by electrophoretic deposition. It will be seen that this process is self-aligning in that it requires only a single mask step to etch ITO stripes 104 and to form SOG insulator 108 in the spacings between stripes 104.

Several other variations in the above processes, such as would be understood by one skilled in the art to which it pertains, are considered to be within the scope of the present invention. As a first such variation, it will be understood that glass layer 88 or 108 may be deposited by a technique other than those described above, for example, chemical vapor deposition or sputter deposition. According to another variation, SOG layer 88 or 108 may be dry etched, illustratively in a plasma reactor. It will also be recognized that a hard mask, such as aluminum or gold, may replace photoresist layers 86, 90 and 106 of the above processes. Finally, photosensitive glass materials are known, and it may be possible to pattern insulator layers 88 and 108 directly, without the use of photoresists.

A field emission flat panel display device, as disclosed herein, having an anode plate which includes grooves in the substrate in the spaces between the conductive regions, and the methods disclosed herein for fabricating such anode plate, overcome limitations and disadvantages of the prior art display devices and methods. The grooves, which are formed in the surface of the substrate after the formation of the stripe conductors, enhance the electrical isolation between adjacent conductors by removing residual traces of conductive material within the spaces between the conductors. Also, field emission from the edges of the conductive stripes may be avoided by etching the grooves, which serve to trim the side edges of the conductors. In addition, the process by which the grooves are formed roughens the surface of the substrate, thereby minimizing surface leakage compared to a smooth surface. By virtue of the increase the electrical isolation of the stripe conductor from one another as a result of the grooves in the substrate, higher anode potentials may be used without the risk of breakdown due to increased leakage current.

The use of an opaque, electrically insulating material within the grooves separating the stripe conductors of the anode provides the advantage of acting as a barrier to the entry of ambient light into the device, and further preventing the reemergence of light reflected from the active surface of emitter plate. The use of an insulating material within the grooves also provides the advantage of improving the definition of the phosphor depositions.

Finally, it is noted that the improved insulating qualities of the anode plate of the present invention will allow the use of narrower spacings between the stripe conductors of the anode, thereby allowing increased anode stripe widths and increasing the area coated by the phosphors. This increased phosphor area reduces the density of the electrons impinging on the phosphor, thereby improving the phosphor efficiency. Hence, for the application to flat panel display devices envisioned herein, the approaches in accordance with the present invention provide significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. An anode plate for use in a field emission device, said anode plate comprising:

a substantially transparent substrate;

spaced-apart, electrically conductive regions on a surface of said substrate; and luminescent material overlying said conductors;

said substrate having grooves formed in said surface in the spaces between said conductive regions.

2. The anode plate in accordance with claim 1 wherein the depth of said grooves below said surface is between 0.3 and 10 μmeters.

3. The anode plate in accordance with claim 1 wherein said conductive regions comprise indium-tin-oxide.

4. The anode plate in accordance with claim 1 wherein said conductive regions are formed as substantially parallel stripes.

5. The anode plate in accordance with claim 1 further including an electrically insulating material within said grooves.

6. The anode plate in accordance with claim 5 wherein said electrically insulating material is substantially opaque and comprises glass mixed with impurities which reduce its transmissivity to visible light.

7. The anode plate in accordance with claim 6 wherein said impurities include the oxide of a transition metal.

8. The anode plate in accordance with claim 6 wherein said impurities include an organic dye.

9. The anode plate in accordance with claim 1 wherein said luminescent material comprises a compound including phosphor.

10. The anode plate in accordance with claim 1 wherein said grooves have sidewalls which are substantially straight.

11. The anode plate in accordance with claim 1 wherein said grooves have sidewalls which undercut said substrate at the edges of said conductive regions.

12. An anode plate for use in a field emission device, said anode plate comprising:

a substantially transparent substrate;

spaced-apart, electrically conductive regions on a surface of said substrate, said substrate having grooves formed in said surface in the spaces between said conductive regions;

luminescent material overlying said conductors; and an electrically insulating material within said grooves.

13. The anode plate in accordance with claim 12 wherein the depth of said grooves below said surface is between 0.3 and 10 μmeters.

14. The anode plate in accordance with claim 12 wherein said conductive regions comprise indium-tin-oxide.

15. The anode plate in accordance with claim 12 wherein said conductive regions are formed as substantially parallel stripes.

16. The anode plate in accordance with claim 12 wherein said electrically insulating material is substantially opaque and comprises glass mixed with impurities which reduce its transmissivity to visible light.

17. The anode plate in accordance with claim 16 wherein said impurities include the oxide of a transition metal.

18. The anode plate in accordance with claim 16 wherein said impurities include an organic dye.

19. The anode plate in accordance with claim 12 wherein said luminescent material comprises a compound including phosphor.

20. The anode plate in accordance with claim 12 wherein said grooves have sidewalls which are substantially straight.

21. The anode plate in accordance with claim 12 wherein said grooves have sidewalls which undercut said substrate at the edges of said conductive regions.

22. An electron emission display apparatus comprising:

an emitter structure including means for emitting electrons;

a display panel including a transparent substrate having a substantially planar surface opposing said emitter structure, spaced-apart, electrically conductive regions on said substantially planar surface, said substrate having grooves formed in said substantially planar surface in the spaces between said conductive regions, and luminescent material overlying said conductors; and means for applying a potential between said emitter structure and said display panel to accelerate electrons emitted by said emitting means toward said conductive regions.

23. The electron emission display apparatus in accordance with claim 22 wherein the depth of said grooves below said surface is between 0.3 and 10 μmeters.

24. The electron emission display apparatus in accordance with claim 22 wherein said conductive regions comprise indium-tin-oxide.

25. The electron emission display apparatus in accordance with claim 22 wherein said conductive regions are formed as substantially parallel stripes.

26. The electron emission display apparatus in accordance with claim 22 further including a substantially opaque, electrically insulating material within said grooves.

27. The electron emission display apparatus in accordance with claim 26 wherein said substantially opaque, electrically insulating material comprises glass mixed with impurities which reduce its transmissivity to visible light.

28. The electron emission display apparatus in accordance with claim 27 wherein said impurities include the oxide of a transition metal.

29. The electron emission display apparatus in accordance with claim 27 wherein said impurities include an organic dye.

30. The electron emission display apparatus in accordance with claim 22 wherein said luminescent material comprises a compound including phosphor.

31. The electron emission display apparatus in accordance with claim 22 wherein said grooves have sidewalls which are substantially straight.

32. The electron emission display apparatus in accordance with claim 22 wherein said grooves have sidewalls which undercut said substrate at the edges of said conductive regions.

33. The electron emission display apparatus in accordance with claim 22 wherein said emitter structure comprises:

a first conductive layer;

an insulating layer on said first conductive layer;

a second conductive layer on said insulating layer, said second conductive layer having a plurality of apertures extending therethrough and through said insulating layer;

second means for applying a potential between said first and second conductive layers; and microtip emitters on said first conductive layer, each emitter formed within a corresponding one of said apertures in said second conductive layer.

* * * * *